US006545223B2

(12) United States Patent
Baldock

(10) Patent No.: US 6,545,223 B2
(45) **Date of Patent: *Apr. 8, 2003**

(54) CABLE

(76) Inventor: George M. Baldock, 4170 N. Marine Dr., #11B, Chicago, IL (US) 60613

( * ) Notice: Subject to any disclaimer, the term of this patent is extended or adjusted under 35 U.S.C. 154(b) by 0 days.

This patent is subject to a terminal disclaimer.

(21) Appl. No.: 09/935,217

(22) Filed: Aug. 22, 2001

(65) Prior Publication Data

US 2003/0037956 A1 Feb. 27, 2003

(51) Int. Cl.[7] ..... H01B 7/08

(52) U.S. Cl. ..... 174/115; 174/117 F

(58) Field of Search ..... 174/36, 115, 117 F, 174/117 FF

(56) References Cited

U.S. PATENT DOCUMENTS

| | | | | | |
|---|---|---|---|---|---|
| 4,376,920 | A | * | 3/1983 | Smith | 174/105 R |
| 5,068,632 | A | * | 11/1991 | Champeau | 174/117 FF |
| 5,349,133 | A | * | 9/1994 | Rogers | 174/106 R |
| 5,900,589 | A | * | 5/1999 | Brunt | 174/117 FF |
| 6,464,516 | B2 | * | 10/2002 | Baldock | 439/120 |

* cited by examiner

*Primary Examiner*—Chau N. Nguyen
(74) *Attorney, Agent, or Firm*—Welsh & Katz, Ltd.

(57) ABSTRACT

An insulated cable having a non-circular cross section with a number of shielding elements is provided. The cable is capable of carrying the transmission typically carried by a coaxial cable and has a thin profile cross-section. The cable, by virtue of the presence of particular shielding elements arranged in a novel manner provides shielding equivalent to the best round profiled coaxial cables while having a thin and non-circular cross-section.

9 Claims, 1 Drawing Sheet

CABLE

REFERENCE TO RELATED APPLICATIONS

The present application is related to U.S. patent application Ser. No. 09/503,891, filed Feb. 15, 2000, now U.S. Pat. No. 6,464,516, which is a continuation-in-part of U.S. patent application Ser. No. 09/156,445, filed Sep. 18, 1998, now abandoned, which is a continuation-in-part of U.S. application Ser. No. 08/940,137, filed Sep. 29, 1997, now U.S. Pat. No. 5,915,980. The present application claims the earlier filing date of U.S. provisional application No. 60/227,120, filed Aug. 22, 2000, and pending as of the filing of this application.

BACKGROUND OF THE INVENTION

The present invention relates generally to a cable used preferably for connections between electronic video and audio components. More particularly, the present invention relates to shielded coaxial, fiber optic and other cables.

Cables used in connecting video components to each other and to cable outlets have generally been of the coaxial variety. Such cables generally comprise a main conductor, some shielding elements, a ground conductor and an external plastic insulating material all generally formed in an elongated cylindrical configuration. While adequate signal transmission has been achieved with such cables, modern uses for cables requires that a variation in the sizes and shapes, particularly of the cross-sectional shapes, of such cables be available.

Unfortunately, the nature of such cables and electrical transmission of signals do not generally lend themselves to cables having a cross-sectional shape other than round. It has been found, generally, that the use of non-circular cross-sectional cables leads to magnetic and static interference in the cable. Such interference is translated into a diminution of the signal. In some instances signal loss is great enough to eliminate the benefits of cable transmission of signals.

Further, it has been found that the use of cables having round cross-sections limits the placement of cables. For example, round cables can not be placed on floors as they are subject to rolling and are likely to cause an individual to trip if stepped upon. Placement of cables beneath rugs or carpeting causes unsightly lumps to appear in the floor covering and can lead to premature wear and tear on the floor covering. Further, such cables can not be attached to a wall or ceiling without the use of unsightly fasteners, such as cable nails or U-shaped fasteners.

It has also been determined that transmission through such cables occurs in a generally star-shaped (at the cross-section of the cable) pattern with signal bouncing inside of the cable and traveling in a somewhat cork-screw pattern along the length of the cable. As a result, co-axial cables made with a round cross-section have been most successful in transmitting signals without creating interfering transmissions.

I have invented a cable that can be made with a variety of cross-sections other than round without a loss of signal strength or diminution of the signal as a result of inadequate or improper shielding. I have found that the signal transmitted in the cable of the present invention generally travels about planarly in a zig-zag like pattern. As a result the cable of the present invention provides signal transmission at the level of the finest co-axial cables without generating errant interfering transmissions.

Other objects and advantages of the present invention will become apparent as the description proceeds.

SUMMARY OF THE INVENTION

The present invention concerns an insulated cable shielded for transmission of RF, comprising a central conductor having an intermediate insulating layer that substantially covers the central conductor. The cable further includes a first discrete shielding layer consisting of a homogeneous electrically conductive material that substantially covers the intermediate insulating layer and shields the central conductor from RFI. A second discrete shielding layer consisting of a homogeneous electrically conductive material that substantially covers the first shielding layer and shields the central conductor from EMI are also included. Further, an outer insulating layer that substantially covers the second shielding layer and protects the insulated cable from damage by external forces, wherein the insulated cable has a noncircular cross-section.

In a preferred embodiment of the insulated cable of cable has a noncircular cross-section and a thickness of less than about 0.10 inches. The insulated cable of the preferred embodiment has a generally rectangular cross-section. It has been determined that the insulated cable of the preferred embodiment, because of its noncircular cross section carries a signal by radiating the signal within the cable from a center conductor in a zig-zag like pattern.

In the preferred embodiments of the present invention the cable is provided with shielding elements that allow the non-circular cross-section with no diminution in signal strength or interference. The cable can be manufactured in a variety of shapes without having signal strength or shielding problems. Such shapes as rectangular, flat, semi-circular or having the shape of certain moldings generally used in wall decorations are possible. The present invention allows for such cables, which can have relatively thin cross-section, to be flexible such that they can be bent to follow the contours of a wall, ceiling, floor or other surface. Further, as the cable of the present invention has a generally flat surface along a length of the cable, the cable can be attached to any surface by the use of adhesives, including adhesive tape or glue. The wiring system includes a connecting module, an insulated cable, and a plug assembly.

DETAILED DESCRIPTION OF THE INVENTION

Figure 1:
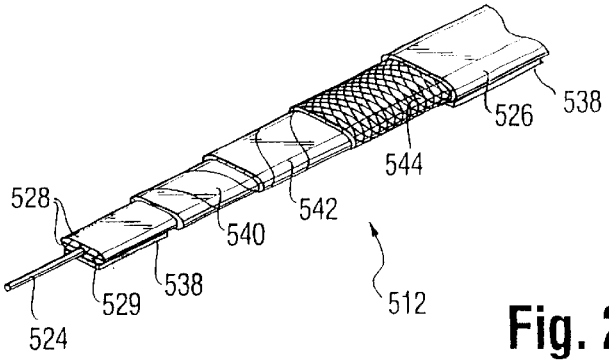
FIG. 1 is a perspective view of a cable of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Invention") relates to a requirement of the United States Patent Office, and should not be found to limit the subject matter disclosed herein.

Referring to the drawings, the present invention is directed to a cable 512. Cable 512 is illustrated as low profile cable. The low profile cable 512 provides sufficient shielding so that it can be used with 75 ohm service similar to conventional coaxial cable. The low profile cable 512 also provides sufficient shielding so that the low profile cable can be used with the transmission of digital signals. It is to be understood that the cables, and particularly the shielding elements of the cables, of the present invention can to be used in connection with fiber optic cables and other cables without departing from the novel scope of the present invention.

Figure 1A:
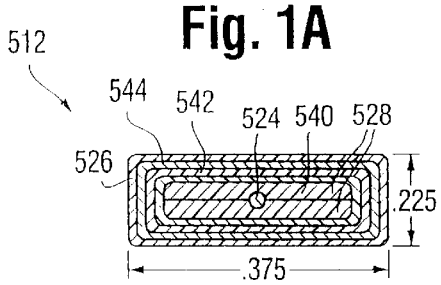
FIG. 1A is an end view of another embodiment of the cable of the present invention.
Figure 2:
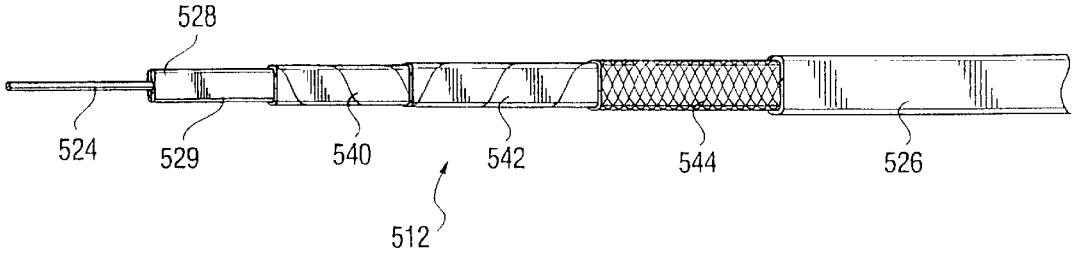
FIG. 2 is a perspective view, partially cut away of another embodiment of the cable of the present invention.
Figure 3:
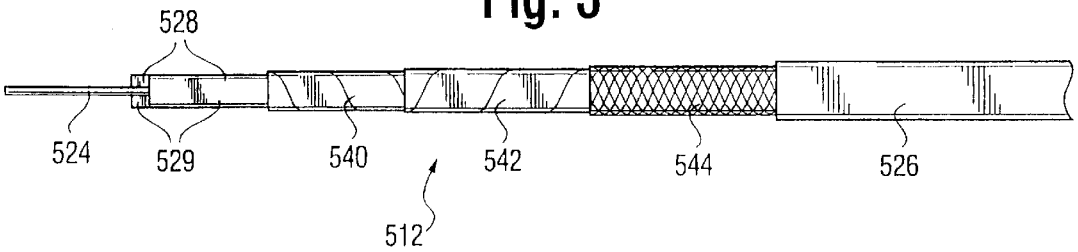
FIG. 3 is a side elevational view, partially cut away, of the cable of FIG. 2.

In the illustrative embodiments, the low profile cable 512 has a thickness of approximately 0.05 inches. It is to be understood that low profile cable 512 can have any desirable thickness without departing from the novel scope of the present invention. While it is possible for the low profile cable 512 to have a width that is approximately the same as the height, the width is preferably between about 0.25 and 0.50 inches to enhance the ability of removably securing the low profile cable 512 to a wall surface (not shown) using an adhesive. It will be understood, by persons having skill in the art, that the present cable may be made with any number of ratios of width to height which can be described as thin profiled, without departing from the novel scope of the present invention. FIG. 3 shows a profile view of a coaxial cable showing the relative thin profile of the cable. FIG. 1A shows a cross-sectional view of one embodiment of the cable of the present invention, showing a rectangular cross-section of a thin profile cable.

The low profile cable 512 includes a central conductor 524, which is preferably fabricated from copper and has a thickness of between 16 and 20 gauge, preferably 18 gauge. It is to be understood by those having skill in the art that the central conductor 512, which may be of a variety of gauges of wire, may or may not be tin coated without departing from the novel scope of the present invention. Tin coating provides a means to prevent oxidation of the conductor and thereby help maintain as strong a signal as possible. An intermediate insulating layer 528 is formed over the central conductor 524. The intermediate insulating layer 528 can be formed from two pieces 529 of flexible polyethylene (PE) which acts as a dielectric coating that are adhered to each other. It is to be understood that intermediate insulating layer 528 can also be created by injection molding or it can be extruded without departing from the novel scope of the present invention. It will also be understood by persons having ordinary skill in the art that any dielectric material, having similar properties, may be used as an intermediate insulating layer without departing from the novel scope of the present invention.

In the use of the two polyethylene pieces 529, it has been found that they may be made in a range of between 0.01 and 0.02 inches but are preferably of a thickness of approximately 0.016 inches. It is to be understood that pieces 529 can have any desirable thickness without departing from the novel scope of the present invention. In the illustrative example, to further reduce the profile of the low profile cable 512, the polyethylene pieces 529 have been tapered so that a thickness of the polyethylene pieces 529 is smaller proximate edge surface of the polyethylene pieces 529. It is to be understood that tapering to other shapes can also be made without departing from the novel scope of the present invention.

Alternatively, the intermediate insulating layer 528 can be formed from gas injected foam. In this configuration the intermediate insulating layer 528 has a thickness of about 0.016 inches where the central conductor 524 extends through the intermediate insulating layer 528. It is to be understood that layer 528 can have any desirable thickness without departing from the novel scope of the present invention.

A first shielding layer 540 is applied of the intermediate insulating layer 528 so that the first shielding layer 540 substantially covers the intermediate insulating layer 528. The first shielding layer 540 is preferably fabricated from aluminum or Mylar and has a thickness of between 0.0005 inches and 0.002 inches but preferably being approximately 0.001 inches. It is to be understood that layer 540 can be manufactured from other materials and have any desirable thickness without departing from the novel scope of the present invention. It has been found that the use of aluminum or Mylar, in the form of thin sheets, as in the present embodiment, typically provides 100% coverage within the layer.

A second insulating layer 542 is preferably applied over the first shielding layer 540 so that the second insulating layer 542 substantially covers the first shielding layer 540 creating a second dielectric shield. The second insulating layer 542 is preferably fabricated from polyethylene and has a thickness of between 0.001 inches and 0.015 inches, preferably having a thickness of approximately 0.008 inches. It will be understood that layer 542 can be made of any desirable thickness without departing from the novel scope of the present invention. It is particularly desirable to use the second insulating layer 542 when the low profile cable 512 is used for the transmission of digital signals.

A third shielding layer 544 is preferably applied over the second insulating layer 542 so that the third shielding layer 544 substantially covers the second insulating layer 542. The third shielding layer 544 is preferably fabricated from a copper sheet and has a thickness of between 0.0005 inches and 0.002 inches, preferably having a thickness of approximately 0.001 inches. It is to be understood that layer 544 can be made of any desirable thickness without departing from the novel scope of the present invention. It is to be further understood, that layer 544 may be made of copper ribbon, foil or a braid, without departing from the novel scope of the present invention. It will be understood by persons having skill in the art that the use of a braid in the outer shielding element of the present invention may be the preferred method of manufacturing the cable of the present invention, due to the availability of copper braid. The third shielding layer 544 is particularly useful to provide EMI shielding.

An outer insulating layer 526 substantially covers the third shielding layer 544 and thereby protects the components of the insulated cable 512 from being damaged. The outer insulating layer 526 is preferably formed from polyvinyl chloride, which is extruded over the third shielding layer 544. Layer 526 can be formed of any number of plastic materials that provide shielding and can be injection molded or extruded without departing from the novel scope of the present invention.

As will be seen in the figures, the present cable may be made in a variety of cross-sectional shapes, each having the same components described above.

Figure 4:
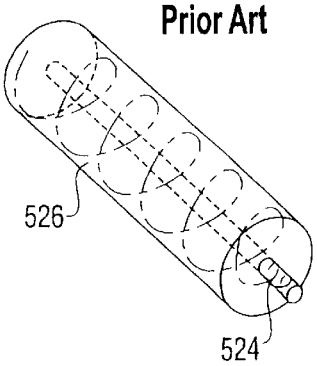
Fig. 4 Prior Art
FIG. 4 is a perspective view, partially cut away, of a coaxial cable of the prior art.
Figure 5:
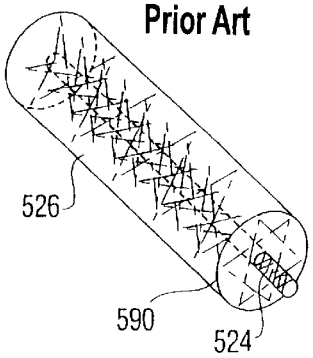
Fig. 5 Prior Art
FIG. 5 is another perspective view of a coaxial cable of the prior art.
Figure 6:
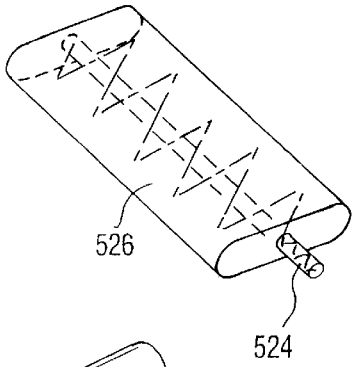
FIG. 6 is a perspective view, cut away, of a cable made in accordance with the teachings of the present invention.
Figure 7:
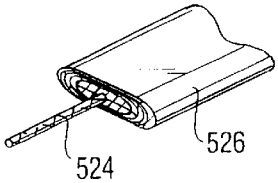
FIG. 7 is another perspective view of a cable made in accordance with the teachings of the present invention.

Referring now to FIGS. 4 and 5, it will be seen that normal coaxial transmission across a cable radiates from center conductor 524 and is continuously contained within the cable by a shielding layer 590. The signal bounces around the conductor 524 in a corkscrew-like fashion until the signal reaches the receiver, or other equipment. As shown in FIGS. 6 and 7, in the device of the present invention, the signal also radiates from the center conductor 524, however, but does not travel in a corkscrew-like fashion to the receiver. Instead, the signal within the cable of the present invention is wavy or zig-zag—like across the width of the cable (somewhat planarly, depending on the thickness of the cable). The signal takes the path of least resistance, moving forwardly and side to side where the shielding layer is farthest from the center conductor 524.

Specific embodiments of a cable according to the present invention have been described for the purpose of illustrating the manner in which the invention can be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed:

1. An insulated cable shielded for transmission of RF, comprising:

a central conductor;

an intermediate insulating layer that substantially covers the central conductor;

a first discrete shielding layer consisting of a homogeneous electrically conductive material that substantially covers the intermediate insulating layer and shields the central conductor from RFI;

a second insulating layer that substantially covers the first discrete shielding layer;

a second discrete shielding layer consisting of a homogeneous electrically conductive material that substantially covers the second insulating layer and shields the central conductor from EMI; and an outer insulating layer that substantially covers the second shielding layer and protects the insulated cable from damage by external forces, wherein the insulated cable has a noncircular cross-section.

2. The insulated cable of claim 1 wherein the insulated cable has a noncircular cross-section and a thickness of less than about 0.10 inches.

3. The insulated cable of claim 1, wherein the cable has a generally rectangular cross-section.

4. The insulated cable of claim 1, wherein the signal carried by said cable radiates within said cable from a center conductor in a zig-zag like pattern.

5. The insulated cable of claim 1, wherein the signal carried by said cable radiates within said cable from a center conductor in a side to side pattern.

6. An insulated cable shielded for transmission of RF, comprising:

a central conductor;

an intermediate insulating layer that substantially covers the central conductor;

a first discrete shielding layer consisting of an electrically conductive material that substantially covers the intermediate insulating layer and shields the central conductor from RF a second insulating layer that substantially covers the first discrete shielding layer;

a second discrete shielding layer consisting of an electrically conductive material that substantially covers the second insulating layer and shields the central conductor from EMI; and an outer insulating layer that substantially covers the second shielding layer and protects the insulated cable from damage by external forces, wherein the insulated cable has a rectangular cross-section and a thickness of less than about 0.10 inches.

7. The insulated cable of claim 6, wherein the signal carried by said cable radiates within said cable from a center conductor in a zig-zag like pattern.

8. The insulated cable of claim 6, wherein the signal carried by said cable radiates within said cable from a center conductor in a side to side pattern.

9. The insulated cable of claim 6, wherein said first and second discrete shielding layers are made of materials that are generally homogenous.

* * * * *

UNITED STATES PATENT AND TRADEMARK OFFICE

CERTIFICATE OF CORRECTION

PATENT NO. : 6,545,223 B2
DATED : April 8, 2003
INVENTOR(S) : George M. Baldock

It is certified that error appears in the above-identified patent and that said Letters Patent is hereby corrected as shown below:

Column 4,
Line 64, the following should be added after the word "invention".
-- In one preferred embodiment, the insulated cable 512 includes a length of adhesion tape 538, typically of the double stick variety known in the art, so that cable 512 may be adhered to a flat surface. It will be understood by persons having skill in the art that any manner of adhesive, including glues, films, other tapes and/or other adhering material and substances, may be used to adhere cable 512 to a surface without departing from the novel scope of the present invention. --;

Column 5, line 29 and Column 6, line 15,
In each instance delete "comprising" and substitute therefore -- consisting of --

Signed and Sealed this

Second Day of September, 2003

JAMES E. ROGAN
*Director of the United States Patent and Trademark Office*